United States Patent [19]

Clayton et al.

[11] Patent Number: 4,850,892

[45] Date of Patent: Jul. 25, 1989

[54] CONNECTING APPARATUS FOR ELECTRICALLY CONNECTING MEMORY MODULES TO A PRINTED CIRCUIT BOARD

[75] Inventors: James E. Clayton, Derry, N.H.; Hooshang Shamash, Chelmsford, Mass.

[73] Assignee: Wang Laboratories, Inc., Lowell, Mass.

[21] Appl. No.: 150,009

[22] Filed: Feb. 3, 1988

Related U.S. Application Data

[63] Continuation of Ser. No. 61,598, Jun. 18, 1987, abandoned, which is a continuation of Ser. No. 809,670, Dec. 16, 1985, abandoned.

[51] Int. Cl.[4] ..... H01R 9/09

[52] U.S. Cl. ..... 439/326; 439/328; 439/636

[58] Field of Search ..... 339/17 C, 17 LC, 75 MP, 339/176 MP, 184 M, 186 M; 439/59–62, 325–328, 629–637

[56] References Cited

U.S. PATENT DOCUMENTS

| | | | |
|---|---|---|---|
| 3,246,279 | 4/1966 | Storcel | 339/184 M |
| 3,710,303 | 1/1973 | Gallagher, Jr. | 339/75 MP |
| 3,920,303 | 11/1975 | Pittman et al. | 439/326 |
| 4,128,289 | 12/1978 | Occhipinti | 339/75 MP |
| 4,136,917 | 1/1979 | Then et al. | 439/326 |
| 4,210,376 | 7/1980 | Hughes et al. | 339/17 LC |
| 4,575,172 | 3/1986 | Walse et al. | 339/75 MP |
| 4,713,013 | 12/1987 | Regnier et al. | 439/62 |

FOREIGN PATENT DOCUMENTS 2305912 10/1976 France ..... 339/176 MP

*Primary Examiner*—Eugene F. Desmond
*Attorney, Agent, or Firm*—Michael H. Shanahan; Kenneth L. Milik

[57] ABSTRACT

A connecting apparatus for electrically connecting memory modules (RAM or ROM) to a printed circuit board (PCB) of a digital electronic computer is disclosed. The apparatus may be used for edge-wise connection of a number of single in-line memory modules (SIMM, a trademark of the present assignee) to the PCB. The apparatus includes the ability to mount multiple memory modules on a single connecting apparatus, and means for electrically selecting a data transfer with one memory module or another on the apparatus. Guide posts of different cross-sectional areas on each side of the apparatus, and longer than various contact pins protruding through the base of the apparatus are provided, so that the mounting of the apparatus on the PCB is polarized. The guide posts also allow for both through-hole and surface mounting of the apparatus. Additionally, securing pegs on the apparatus are inserted into correspondingly sized holes on the memory modules to prevent vertical movement of the memory modules when connected. In an alternate embodiment, the apparatus angles the memory modules at some angle $\beta$ away from the vertical plane to significantly reduce the effective height of the connected memory modules above a PCB.

11 Claims, 4 Drawing Sheets

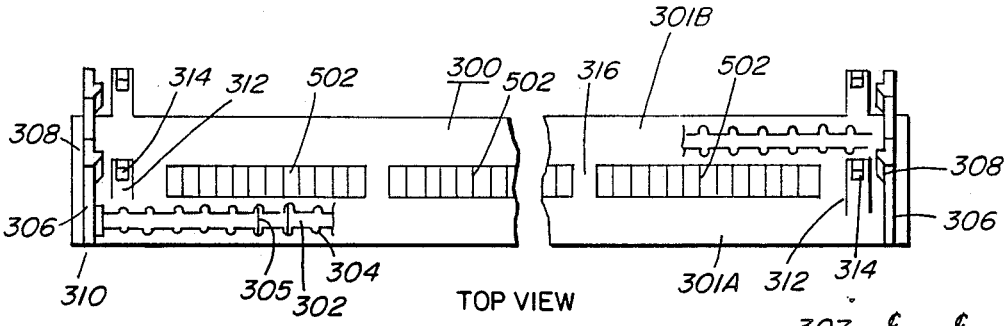
FIG. 6A
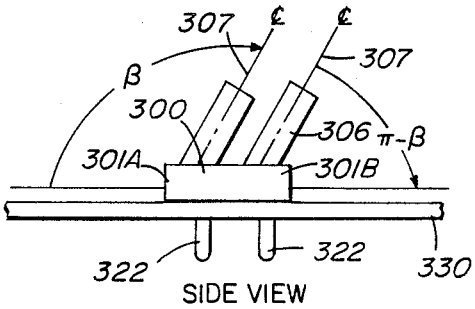
FIG. 6B
FIG. 7A
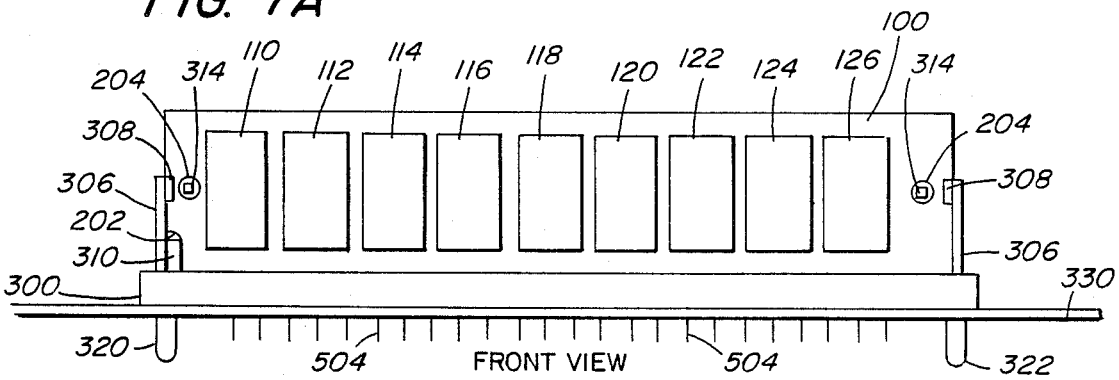
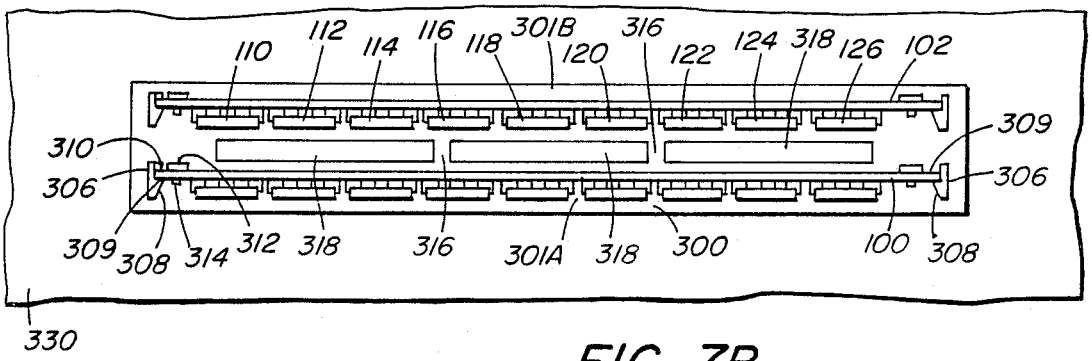
FIG. 7B

CONNECTING APPARATUS FOR ELECTRICALLY CONNECTING MEMORY MODULES TO A PRINTED CIRCUIT BOARD

This is a continuation of Ser. No. 061,598, June 18, 1987, abandoned, which is a continuation of Ser. No. 809,670, Dec. 16, 1985, abandoned.

BACKGROUND OF THE INVENTION

This invention relates generally to apparatuses for packaging digital electronic circuits. More specifically, the present invention relates to single in-line memory modules (SIMMs, a trademark of the present assignee), such as disclosed by U.S. patent application Ser. No. 528,817, filed Sept. 2, 1985, now abandoned.

A problem in need of a solution is how to connect and disconnect these memory modules quickly with automatic alignment and polarity. A solution would allow for greater automation of digital electronic circuits—especially those used in computers.

SUMMARY OF THE INVENTION

Accordingly, it is a principal object of this invention to provide an efficient connecting apparatus for removable, edge-wise joining of a memory module (especially a SIMM) to a printed circuit board (PCB).

Also, it is an object of this invention to provide a memory module connecting apparatus with an efficient vertical positioning and restraint means.

Another object of this invention is to provide a connecting apparatus wherein the memory module is correctly oriented when connected to the contacts of the mounting apparatus.

Yet another object of this invention is to provide a connecting apparatus which can be either through-hole or surface mounted on a PCB.

Still another object of this invent-ion is to provide a connecting apparatus which is properly polarized, i.e. oriented, when mounted on a PCB.

Additionally, it is an object of this invention to reduce the effective height of the assembly of the memory modules and the connecting apparatus.

Further, an object of the present invention is to provide a connecting apparatus capable of supporting multiple memory modules.

Finally, it is an object of this invention to provide for an efficient means of addressing multiple memory modules and the memory chips on the modules.

The foregoing and other objects of the present invention are realized by joining two or more channel mounts, each containing a channel for edge-wise receiving of a memory module, and including shorting bars to electrically connect corresponding contact pins coupled to the memory chips of the memory module. End and side retention posts are added to the ends and one side of each channel mount. The side retention posts contain securing pegs which protrude through corresponding holes in the memory module, thereby vertically stabilizing the memory module while connected. The end retention posts include latches to lock the module in place as noted below.

The channels contain resilient electrical contact mechanisms which introduce a moment to the edge of the memory module when it is inserted into the channel and rotated. The latches on the end retention posts oppose the moment, and thus position and retain the memory module.

One orientation block is located at an end of each channel mount. The orientation blocks are aligned with a unique notch on the memory modules to provide the proper polarity or orientation of the memory modules relative to the PCB.

Guide posts are located at one bottom of each end of the connecting apparatus; the guide posts of the one cross-sectional area, while the guide posts on the other end have another cross-sectional area. To mount the connecting apparatus, the guide posts are inserted into correspondingly sized guide post holes, i.e. matched, on the PCB, with only one orientation of the connecting apparatus possible. The guide posts are also longer than the contact pins protruding from the channel mounts (mentioned supra), so that the connecting apparatus can either be through-hole, or surface mounted.

The end and side retention posts are tilted away from the normal to the channel mounts to reduce the effective height of the assembly.

DESCRIPTION OF THE DRAWINGS

The foregoing and other objects and features of the present invention are apparent from the specification, the drawings and the two taken together. The drawings are:

FIG. 6A is a top view of an alternate embodiment of the connecting apparatus of FIG. 3.

FIG. 6B is a side view of the connecting apparatus of FIG. 6A with guide posts protruding through a PCB.

FIG. 7A is a front elevation view of the apparatus of FIG. 3 with the memory module inserted into the connecting apparatus and the connecting apparatus mounted on the PCB.

FIG. 7B is a top view of the connecting apparatus of FIG. 7A.

DETAILED DESCRIPTION

Figure 1:
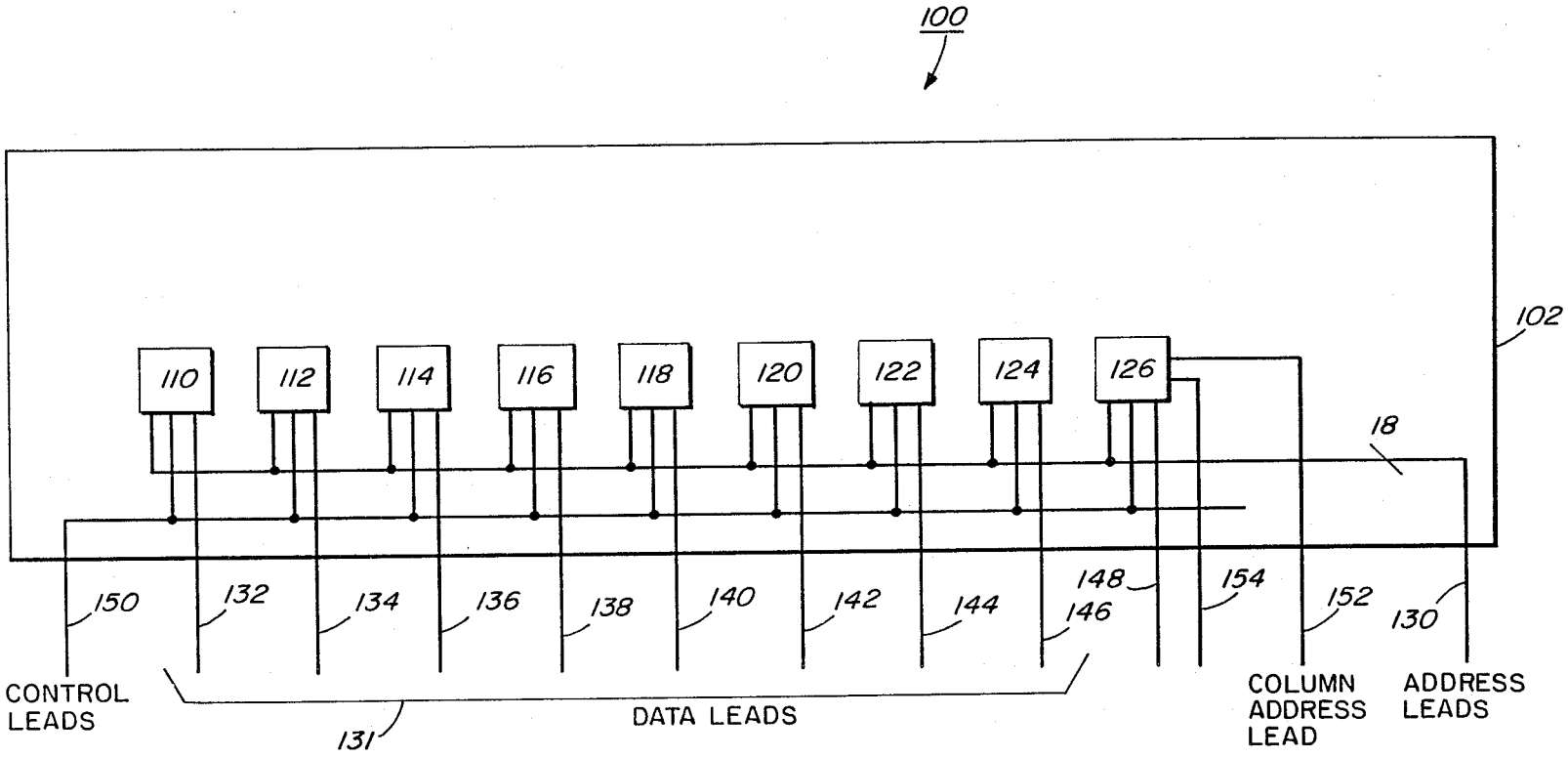
FIG. 1 is an electrical block diagram of a single in-line memory module.

A brief description of a SIMM will first be given. A typical SIMM 100 is shown in FIG. 1. Several memory chips 110–126 are mounted on a substrate 102. Memory chip 126 is part of a parity bit generator with an extra data line 154 and a separate column address line 152. The column address line 152 allows for independent operation of the parity generation chip 126.

The other memory chips 110–124 store and output data forming the bits of an eight-bit binary word. Data lines 131 serve both to input and output data to and from the memory chips 110–124. A multiple number of address lead lines represented by the single line 130 select a location in each memory chip 110–126 from which data is read or written. The control lead 150 controls whether the performed operation is a "read" or "write."

In operation, the memory module 100 stores and retrieves data in the form of an eight-bit binary word having a ninth bit for parity checking. The various leads 130, 131, 150 and 152 extend to an edge of the memory module 100, where edge-wise connection of the module leads is made (not shown).

Figure 3:
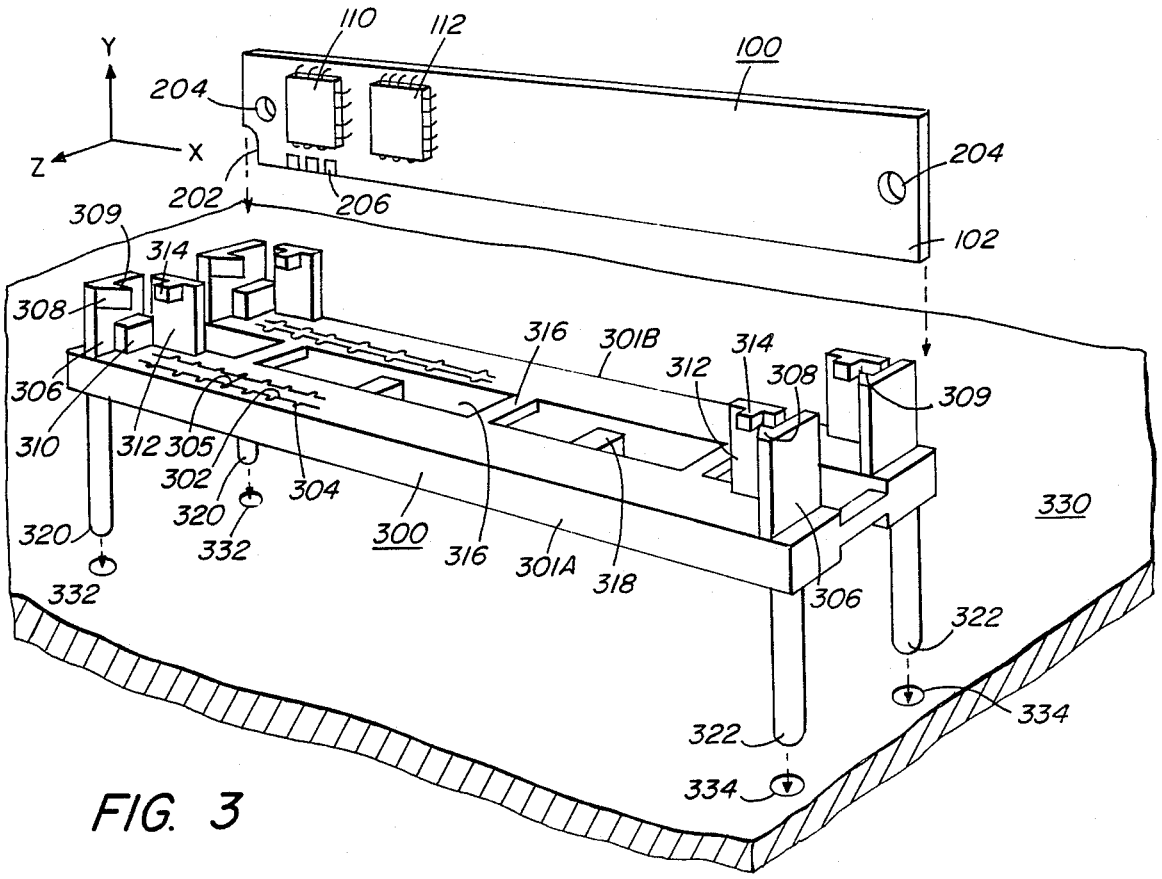
FIG. 3 is an exploded, isometric view of one embodiment of the connecting apparatus of the present invention, a memory module and a PCB.

FIG. 3 shows the memory module connector 300 of the present invention. It is used to connect the memory module 100 to the rest of circuit in a digital electronic computer; e.g., a PCB 330. A brief description of the memory module connector 300 is as follows. The memory module connector 300 contains two identical channel mounts 301A and 301B separated by a space 318, and joined by spars 316. The dual channel mount arrangement serves, inter alia, to increase the structural integrity of the connecting apparatus 300, over that of a single channel mount arrangement. Channel mount 301A carries a channel 302 for receiving the edge of a memory module 100. End retention posts 306, containing latches 308 are located at each end of the channel mount 301A. An orientation block 310 is coupled to one of the end retention posts 306. Side retention posts 312, with securing pegs 314, are located along the side of the channel mount 301A. Guide posts 320 and 322 are located at the bottom of the channel mount 301A.

Figure 2:
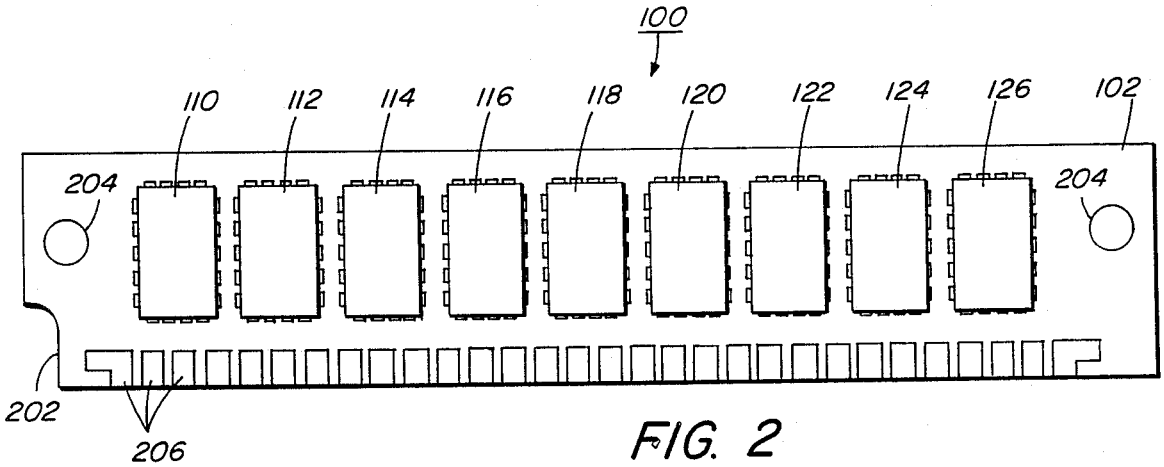
FIG. 2 is a plan view of a mechanical representation of a single in-line memory module.

Turning now to FIG. 2, the preferred embodiment for memory module 100 is shown. The substrate 102 of memory module 100 contains an orientation notch 202 which fits over or aligns with orientation block 310, so that the memory module 100 is connected (or mounted) correctly relative to its edge connectors 206. Securing holes 204 at each end of the substrate 102 are for receiving, locking or securing pegs 314 on the side retention posts 312. Each edge connector 206 is electrically coupled to one of the various leads 130, 131, 148, 150, 152 or 154. Thirty edge connectors 206 are used in the preferred embodiment for a 256 kilobyte memory module. Also, each edge connector 206 has a matching edge connector located on the other side of the substrate 102 in the same relative position. This serves to add redundancy to the memory module; i.e., if one of the edge connectors 206 fails to make the proper electrical contact, the other edge connector 206 in the pair is available to make electrical contact. In the preferred embodiment the edge connectors are made of high pressure tin to allow for greater contact pressure than, for example, gold connectors.

Returning to FIG. 3, the memory module connector or connecting apparatus 300 includes two identical channel mounts 301A and 301B for mounting or carrying two modules 100. Channels 302A and 302B formed in each channel mount 301A and 301B accept an edge 102 of a memory module 100. The channels 302A and B have grooves or slots 304, each containing a contact mechanism 305 for making electrical contact with a corresponding edge contact 206 on a memory module 100. One embodiment of the contact mechanisms 305 is shown in detail in FIGS. 4A and 4B.

Figure 4A:
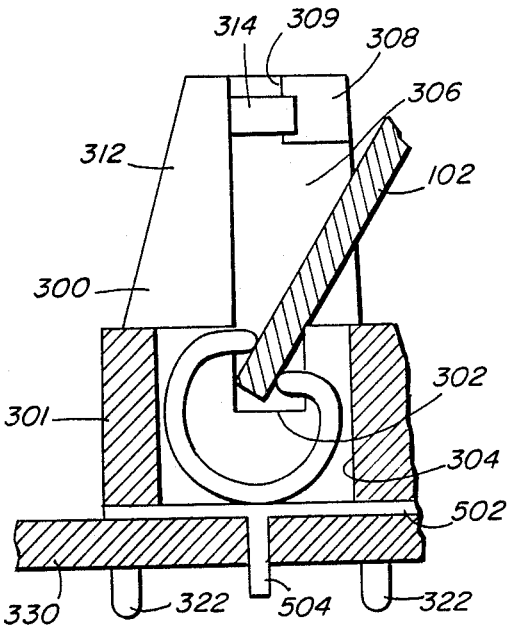
FIG. 4A is a cross-sectional view of an electrical contact mechanism in the channel mount of the connecting apparatus and a portion of the PCB, and a portion of a memory module in the inserted but non-rotated position.

In FIG. 4A the contact mechanism 305 is substantially a "C" shaped spring located inside of a channel slot 304. The substrate 102 of the memory module 100 is shown at an initial insertion stage in the contact 305. The top edge of the contact or spring 305 forces or biases the substrate 102 away from the side retention post 312. The spring 305 thus creates a moment on the substrate 102 when the substrate 102 is rotated or pivoted to a vertical position as shown in FIG. 4B, which is counteracted by a latch 308 on each end retention post 306 (infra) to bring the substrate 102 flush with the side retention posts 312.

Figure 4B:
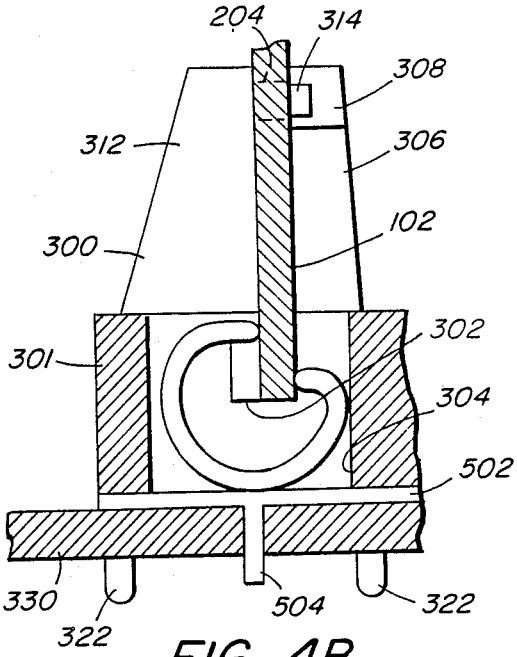
FIG. 4B is the cross-section of FIG. 4A with the memory module inserted and fully rotated into a latched position.

The memory module 100 is swiveled from the position shown in FIG. 4A to the position in FIG. 4B. To accomplish this, a moment generated by the mechanically biased contact mechanism 305 is counteracted. The wedge-shaped latches 308 provide a counteracting force to oppose the moment. The end retention posts 306 are momentarily deflected away from the memory module 100 to enable the flat edge 309 of the latch 308 to touch the substrate 102, thereby locking it in position. The memory module is now in the latched position, and cannot be removed unless the end retention posts 306 are pulled away from the center of the channel mount to release the latches 308. The securing holes 204 in the substrate 102 slide over the securing pegs 314 on the side retention post 312. To complete removal of the memory module 100, it is swiveled away from the side retention posts 312 and lifted from the channel 302.

Once inserted in channels 302 a memory module 100 is bordered by end retention posts 306 and side retention posts 312. The end retention posts 306 position the memory module 100 in the proper place along the channel 302; i.e., the memory module 100 is placed such that each edge connector 206 is matched with a corresponding slot 304 containing a biased contact 305. The biased contact 305, known as a "tulip" contact can make an electrical conduction path with either the upper or lower edge of the C shaped spring. When properly mated with the memory module 100, the biased contact 305 can conduct as a result of the electrical coupling with either of a pair of matching edge connectors 206, thereby adding redundancy to the connecting apparatus 300. Thus the memory module connector 300 makes electrical contact with each data lead 131, leads 130, 150, 152 and 154, making each memory chip 110-126 fully accessible from the memory module connector 300.

The latch 308 is located on each end retention post 306, for latching or locking the memory module 100 into place after it is inserted edgewise into a channel 302A or B, and its free edge swiveled toward the retention posts 312. The latches 308 are wedge-shaped towards the front, and contain a flat edge along the y-x plane as defined in FIG. 3. During connection the ends of the memory module 100 impinge upon the wedges to force the end retention posts outward until the flat region of the latch (along the y-x plane) is reached by the memory module 100. The end retention posts 306 then move towards the center of the channel mount until the flat region is completely touching the substrate 102 (see FIG. 7B).

The orientation block 310 is located on or above the channel mount 301—one for each channel. It is attached to an end retention post 306, as shown in FIG. 3, or on a retention post 312. The orientation block 310 fits in the orientation notch 202 of the memory module 100. Since only one each of an orientation notch 202 and an orientation block 310 is located on each channel mount 301, the memory module 100 is only inserted in the channel 302 with one orientation; i.e., the end of the memory module 100 with the orientation notch 202 is positioned at the end of the memory module connector 300 having the orientation block 310. As a result of this automatic orientation feature the memory module 100 is inserted in the memory module connector 300 without concern for improper orientation or mismatching of the electrical connection mechanisms 305 and the various leads 130, 131, 150, 152 and 154.

The retention posts 312 prevent a connected memory module 100 from moving in the negative z-axis direction. It also serves to prevent further (rolling) motion of the unconnected end of memory module 100 when the electrical contact mechanisms 305 are fully and properly engaged. Each retention post 312 has affixed to it a securing peg 314. Each securing peg 314 is inserted into a corresponding securing hole 204 of the memory module 100. When the memory module 100 is connected by the connector 300 the combination of the securing pegs 314 and the securing holes 204 prevents the memory module 100 from being dislodged from the channel 302 (and thus breaking electrical contact). The tolerance between the area of the securing peg holes 204 and the area of the securing pegs 314 is low enough so that any movement of the memory module 100 while connected is not enough to break the electrical contact of the leads 130, 131, 150, 152 and 154, and the electrical contact mechanisms 305.

The components of each channel mount 301 have been described. Each channel mount 301 accommodates one memory module 100. A channel mount 301 with its concomitant components is connected to another such channel mount 301 by spars 316, and separated by a space 318. Two channel mount assemblies make up the memory module connector 300 in the preferred embodiment.

Again referring to FIG. 3, the memory module connector 300 contains guide posts 320 and 322. The guide posts 320 are distinctly smaller in cross-sectional area than the guide posts 322. The guide posts 320 and 322 correspond to appropriately sized printed circuit board holes 332 and 334 located on a PCB 330. Thus the guide posts 320 and 322 serve to polarize the memory module connector 300 by allowing only one mode of insertion into the holes 332 and 334 of the the PCB 330. Additionally, the guide posts 320 and 322 serve to center the contact pins 504 with their corresponding holes during through-hole mounting of the connecting apparatus 300. Also, the connecting apparatus 300 can be surface mounted in an alternate embodiment without contact pins 504 by securing the guide posts 320–322 to the PCB, once inserted in their respective holes 332 and 334.

Figure 5:
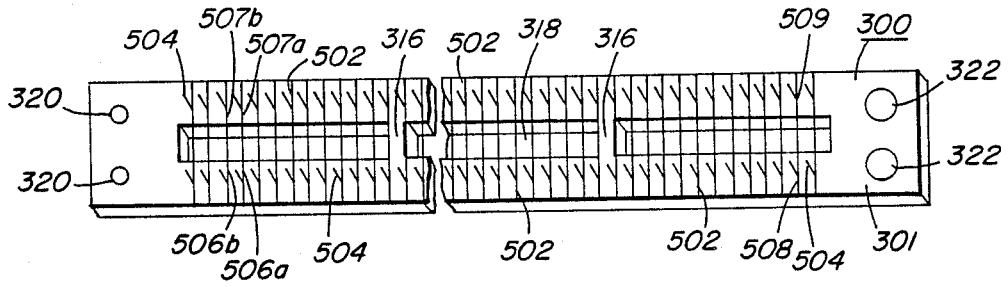
FIG. 5 is an isometric view showing the bottom of the connecting apparatus.

FIG. 5 shows the underside of a memory module connector 300. The connecting leads or pins 504, generally perpendicular to the bottom of the channel mount 301, are electrically coupled to the "C" shaped contacts 305 in the channel slots 304 (See FIGS. 4A and 4B). The data lead connectors or shorting bars 502 connect corresponding pins 504 from each channel 302, so that the data leads 131 of the memory module 100 in one channel 302 share the data leads 131 of the other channel 302. In operation, data signals are sent to or received from both corresponding contact pins 504. However, only one memory module 100 is enabled at a particular time.

The memory module 100 is enabled by the control lead or control line 150, to either read or write (See FIG. 1). The control lead connectors 508 and 509 are not shorted to enable the control lead lines 150 of each memory module 100 to be operated independently of each other. While connector 508 is enabled, connector 509 is disabled, and vice versa. Other leads on the two memory modules 100 are also able to be operated independently of each other by eliminating the shorting bar 502 as illustrated by connectors 506A and B and 507A and B.

One major advantage of shorting the data leads 131 with shorting bars 502 is a reduction in the number of leads needed to operate the memory modules 100. Another advantage is that by making such connections on the connecting apparatus 300, fewer connections and soldering joints are needed on the PCB 330.

FIGS. 6A and 6B show the top and side views, respectively, of an alternate embodiment of the memory module connector 300. In this embodiment the side retention posts 312 and the end retention posts 306 are rotated in the y-z plane at an angle $\beta$, where $\beta$ is greater than 90°. The memory modules 100 are roughly mounted at angle $\beta$. Mounting the memory modules at angle $\beta$ has the effect of reducing the vertical distance (along the y-axis) from the PCB 330 to the upper most edges of the memory modules 100, thereby more efficiently utilizing vertical space. In the preferred embodiment angle $\beta$ is approximately equal to 150°.

FIGS. 7A and 7B are front and top views, respectively, of the memory module connector 300 of FIG. 3 loaded with the memory modules 100. The connection of the memory module 100 and the memory module connector 300 to the PCB 330 is as follows. First, the edge of the substrate 102 with the various input/output leads is inserted into the channel 302 between the end retention posts 306 at an angle. The top of the the memory module 100 is swiveled until the memory module 100 is latched by latches 308. Simultaneously, the securing pegs 314 enter the securing holes 204. The memory module 100 is now firmly connected to the memory module connector 300. The memory module 100 is removed by prying the end retention posts 306 outward until the latches 308 are disengaged, and then swiveling the memory module 100 away from the retention posts 312. The memory module 100 is then removed from the channel 302 with ease.

Various modifications and variations of the foregoing described invention are obvious to those skilled in the art. Such modifications and variations are intended to be within the scope of the present invention. The embodiment described is representative of a multitude of variations without changing the essence of the apparatus operation. For example, more than two channel mount assemblies could be cascaded to form a multi-row memory module connector 300 having n rows (or channels 302), where n represents any positive integer. Also, other types of modules having edge connectors, e.g., "hybrid" modules (those containing components in addition to memory), can be used in place of the single in-line memory modules described above.

What is claimed is:

1. Connecting apparatus for electrically connecting memory modules having electrical edge contacts substantially along one of the module's edges to a printed circuit board (PCB) of a digital electronic circuit comprising:

a channel mount having a channel therein for edgewise receiving said memory module, said channel containing spring contacts for electrically coupling the edge contacts of said memory module when the module is inserted and rotated in said channel and for producing a moment thereon;

lead means for electrically coupling the spring contacts in the channel to electrical lead lines on the PCB;

one end retention post at each end of said channel including a latch for holding said memory module in a fixed position while inserted into the channel by opposing the moment produced by said spring contacts on the memory module, said end retention posts being flexible in the longitudinal direction of the channel to allow separation thereof for insertion of said memory module therebetween; and at least two side retention posts, separate from said end retention posts, for preventing a connected memory module from rotating beyond a predetermined angular position, each said side retention post having a securing peg thereon above the plane of the channel mount for engaging a securing hole of said module and for extending through the full thickness of said module to provide positive locking of said memory module in said channel.

2. The connecting apparatus of claim 1 further comprising:

an orientation block at one end of said channel mount to be aligned with a notch on one end of said memory module, the end of said channel mount with said orientation block accepting only the end of said memory module having said notch.

3. The connecting apparatus of claim 1 further comprising:

an orientation block at one end of said channel mount to be aligned with a notch on one end of said memory module, the end of said channel mount with said orientation block accepting only the end of said memory module having said notch;

at least one guide post at one end of the bottom of said channel mount having a first cross-sectional area and at least one guide post at the other end of the bottom of the channel mount having a second cross-sectional area, said guide posts insertable in matching guide post holes of said PCB and longer than said lead means, whereby said lead means can either be connected through said PCB or on the surface of said PCB, and a desired polarity of said connecting apparatus relative to the PCB is produced; and the centerlines of said end retention posts and said side retention posts form an angle with the plane of said channel mount which is different from 90°.

4. The connecting apparatus of claim 1 wherein the centerlines of said retention posts form an angle with the plane of said channel mount which is different from 90°.

5. The connecting apparatus of claim 4 wherein the angle is about 150°.

6. Connecting apparatus for electrically connecting memory modules having electrical contacts substantially along one of the module's edges to a PCB of a digital electronic circuit comprising:

at least two channel mounts, each having a channel therein for edge-wise receiving said memory modules, each said channel containing spring contacts for electrically coupling the edge contacts of said memory modules when the module is inserted and rotated in said channel and for producing a moment thereon, and each channel capable of accepting the edge of one memory module;

lead means for electrically coupling the spring contacts in the channels to electrical lead lines on the PCB;

one end retention post at each end of each channel, each said end retention post including a latch for holding a memory module in a fixed position while inserted into a channel by opposing the moment produced by said spring contacts on the memory module edge contacts, said end retention posts being flexible in the longitudinal direction of the channel to allow separation thereof for insertion of said memory module therebetween; and at least two side retention posts, separate from said end retention posts, for preventing a connected memory module from rotating beyond a predetermined angular position, each said side retention post having a securing peg thereon above the plane of the channel mount for engaging a securing hole of said module and for extending through the full thickness of said module to provide positive locking of said memory module in said channel.

7. Connecting apparatus for electrically connecting memory modules having electrical contacts substantially along one of the module's edges to a PCB of a digital electronic circuit comprising:

at least one two channel mounts, each having a channel therein for edge-wise receiving said memory modules, each said channel containing spring contacts for electrically coupling the edge contacts of said memory modules when the module is inserted and rotated in said channel and for producing a moment thereon, and each channel capable of accepting the edge of one memory module;

lead means for electrically coupling the spring contacts in the channels to electrical lead lines on the PCB;

one end retention post at each end of each channel, each said end retention post including a latch for holding a memory module in a fixed position while inserted into a channel by opposing the moment produced by said spring contacts on the memory module edge contacts;

at least two side retention posts on each channel mount for lateral positioning and restraint of a memory module, each said side retention post having securing pegs that protrude through securing peg holes in the memory module for vertical positioning and restraint of the memory module;

separate control lead lines coupled to spring contacts on separate channel mounts, each channel to activate one module at a time for data transfer; and common data and address lead lines coupled to spring contacts on both channel mounts, each said data and address line coupled to a corresponding electrical contact on each channel for transferring data and address signals.

8. The connecting apparatus of claim 7 further comprising: an orientation block at one of each said channel mount to be aligned with a notch on one end of a memory module, the end of said channel mount with said orientation block accepting only the end of the memory module having said notch;

at least one guide post at one end of the bottoms of each said channel mount having a first cross-sectional area and at least one guide post at the other end of the bottoms of each said channel mounts having a second cross-sectional area, said guide posts insertable in matching guide post holes of said PCB and longer than said lead means, whereby said lead means can either be connected through said PCB or on the surface of said PCB, and a desired polarity of said connecting apparatus is produced; and the centerlines of said end retention posts and said side retention posts form an angle with the plane of said channel mounts which is different from 90°.

9. Connecting apparatus for electrically connecting memory modules having electrical contacts substantially along one of the module's edges to a PCB of a digital electronic circuit comprising:

a channel mount having a channel therein for edge-wise receiving said memory module, said channel containing spring contacts for electrically coupling the edge contacts of said memory module when the module is inserted and rotated in said channel and for producing a moment thereon;

lead means for electrically coupling the spring contacts in the channel to electrical lead lines on the PCB;

one flexible end retention post at each end of the channel including a latch for holding the memory module in a fixed position while inserted into a channel by opposing the moment produced by the spring contacts on the memory module; and at least two side retention posts, separate from said end retention posts, for preventing a connected memory module from rotating beyond a predetermined angular position, each said side retention post having a securing peg thereon above the plane of the channel mount for engaging a securing hole of said module and for extending through the full thickness thereof for providing positive locking of said memory module in said channel.

10. Connecting apparatus for electrically connecting memory modules having electrical contacts substantially along one of the module's edges to a PCB of a digital electronic circuit comprising:

at least two channel mounts, each having channel therein for edge-wise receiving said memory modules, each said channel containing spring contacts for electrically coupling the edge contacts of said memory modules when the module is inserted and rotated in said channel producing a moment thereon, and each channel capable of accepting the edge of one memory module;

lead means for electrically coupling the spring contacts in the channels to electrical lead lines on the PCB;

one end retention post at each end of each channel, each said end retention post including a latch for holding a memory module in a fixed position while inserted into a channel by opposing the moment produced by said spring contacts on the memory module edge contacts;

at least two side retention posts on each channel mount for lateral positioning and restraint of a memory module, each said side retention post having securing pegs that protrude through securing peg holes in the memory module for vertical positioning end restraint of the memory module;

separate control lead lines coupled to spring contacts on separate channel mounts, each channel to activate one module for data transfer; and data and address lead lines coupled to spring contacts on both channel mounts, each said data and address line coupled to a corresponding electrical contact on each channel for transferring data and address signals.

11. The connecting apparatus of claim 10 further comprising:

an orientation block at one end of each said channel mount to be aligned with a notch on one end of a memory module, the end of said channel mount with said orientation block accepting only the end of the memory module having said notch;

at least one guide post at one end of the bottoms of each said channel mounts having a first cross-sectional area and at least one guide post at the other end of the bottoms of each said channel mounts having a second cross-sectional area, said guide posts insertable in matching guide post holes of said PCB and longer than said lead means, whereby said lead means can either be connected through said PCB or on the surface of said PCB, and a desired polarity of said connecting apparatus is produced; and the centerlines of said end retention posts and said side retention posts form an angle with the plane of said channel mounts plane which is different from 90°.

* * * * *

UNITED STATES PATENT AND TRADEMARK OFFICE

CERTIFICATE OF CORRECTION

PATENT NO. : 4,850,892

DATED : July 25, 1989

INVENTOR(S) : James E. Clayton, et al.

It is certified that error appears in the above-identified patent and that said Letters Patent is hereby corrected as shown below:

Column 8, line 22, "one two channel" should read --two channel--.

Signed and Sealed this

Thirtieth Day of April, 1991

*Attest:*

HARRY F. MANBECK, JR.

*Attesting Officer*

*Commissioner of Patents and Trademarks*